US012631427B2

(12) United States Patent
Meissen et al.

(10) Patent No.: US 12,631,427 B2
(45) Date of Patent: May 19, 2026

(54) FIREARM FOREGRIP WITH ILLUMINATOR

(71) Applicant: Crimson Trace Corporation, Columbia, MO (US)

(72) Inventors: Tim Meissen, Columbia, MO (US); William A. Planck, Columbia, MO (US); Michael Cottrell, Ashland, MO (US); James Tayon, Moberly, MO (US); Ryan Donahue, Columbia, MO (US); John Oller, Columbia, MO (US); Shane Ball, Columbia, MO (US); Logan Garland, Columbia, MO (US)

(73) Assignee: Crimson Trace Corporation, Columbia, MO (US)

( * ) Notice: Subject to any disclaimer, the term of this patent is extended or adjusted under 35 U.S.C. 154(b) by 0 days.

(21) Appl. No.: 18/954,696

(22) Filed: Nov. 21, 2024

(65) Prior Publication Data

US 2025/0085087 A1 Mar. 13, 2025

Related U.S. Application Data

(63) Continuation of application No. 18/411,536, filed on Jan. 12, 2024, now Pat. No. 12,173,986, which is a continuation of application No. 17/983,391, filed on Nov. 8, 2022, now Pat. No. 11,906,267.

(60) Provisional application No. 63/263,705, filed on Nov. 8, 2021.

(51) Int. Cl.
*F41G 1/35* (2006.01)

(52) U.S. Cl.
CPC ..... *F41G 1/35* (2013.01)

(58) Field of Classification Search
CPC ..... F41G 1/22; F41G 1/35
See application file for complete search history.

(56) References Cited

U.S. PATENT DOCUMENTS

| | | | |
|---|---|---|---|
| 6,523,972 | B2 | 2/2003 | Sharrah et al. |
| 7,264,369 | B1 | 9/2007 | Howe |
| D643,497 | S | 8/2011 | Fitzpatrick et al. |
| 8,117,782 | B2 | 2/2012 | Gross et al. |
| D665,043 | S | 8/2012 | Fitzpatrick et al. |
| D674,861 | S | 1/2013 | Johnston et al. |
| 8,438,769 | B1 | 5/2013 | Ghannam |
| 8,485,686 | B2 | 7/2013 | Swan et al. |
| D694,848 | S | 12/2013 | Anderson et al. |

(Continued)

FOREIGN PATENT DOCUMENTS

| | | | |
|---|---|---|---|
| EP | 4109033 | A1 | 12/2022 |
| WO | 2008088362 | A2 | 7/2008 |

OTHER PUBLICATIONS

Innovation Q+ NPL Search (Year: 2024).*

(Continued)

*Primary Examiner* — Anabel Ton
(74) *Attorney, Agent, or Firm* — Stinson LLP

(57) ABSTRACT

A firearm accessory and associated components and methods. The firearm accessory can include a foregrip and/or an illuminator (e.g., light and/or laser). The firearm accessory can include a support body selectively operatively connectable to a support body receiver in a first orientation and in a second orientation. The support body can include an actuator configured to change an operational state of the illuminator and/or a port configured to connect a remote actuator to the support body.

20 Claims, 15 Drawing Sheets

(56) References Cited

U.S. PATENT DOCUMENTS

| | | | |
|---|---|---|---|
| D698,885 | S | 2/2014 | Faifer |
| 8,683,733 | B2 | 4/2014 | Gross et al. |
| 8,707,604 | B2 | 4/2014 | Troy et al. |
| D709,159 | S | 7/2014 | Gibson et al. |
| D728,054 | S | 4/2015 | Webber |
| 9,062,933 | B1 | 6/2015 | Allen et al. |
| 9,182,194 | B2 | 11/2015 | Moore |
| 9,194,652 | B2 | 11/2015 | Esserman et al. |
| D745,623 | S | 12/2015 | Flores |
| D745,624 | S | 12/2015 | Flores |
| D745,629 | S | 12/2015 | Barfoot et al. |
| D745,940 | S | 12/2015 | Flores |
| 9,228,804 | B2 | 1/2016 | Syrengelas et al. |
| 9,341,440 | B2 | 5/2016 | Moore |
| D779,017 | S | 2/2017 | Liu |
| D783,757 | S | 4/2017 | Jen |
| D785,744 | S | 5/2017 | Bosco et al. |
| D786,383 | S | 5/2017 | Saadon |
| D786,384 | S | 5/2017 | Saadon |
| D786,389 | S | 5/2017 | Zemel et al. |
| D790,650 | S | 6/2017 | Saadon |
| D790,651 | S | 6/2017 | Saadon |
| 9,696,111 | B2 | 7/2017 | Saadon |
| 9,713,217 | B2 | 7/2017 | Bayat et al. |
| 9,784,527 | B2 | 10/2017 | Helms |
| D803,966 | S | 11/2017 | Saadon |
| D803,967 | S | 11/2017 | Saadon |
| D803,968 | S | 11/2017 | Saadon |
| D803,969 | S | 11/2017 | Saadon |
| D803,971 | S | 11/2017 | Saadon |
| 9,841,254 | B2 | 12/2017 | Moore |
| 9,891,020 | B2 | 2/2018 | Jen |
| 9,927,209 | B2 | 3/2018 | Sharrah et al. |
| D841,756 | S | 2/2019 | Saadon |
| D842,416 | S | 3/2019 | Saadon |
| 10,222,171 | B2 | 3/2019 | Chavez |
| D846,057 | S | 4/2019 | Cheng et al. |
| 10,267,594 | B2 | 4/2019 | Saadon |
| D860,375 | S | 9/2019 | Chavez |
| D869,596 | S | 12/2019 | Huston |
| D876,570 | S | 2/2020 | Saadon |
| D881,430 | S | 4/2020 | Mao |
| D898,153 | S | 10/2020 | Podgurny |
| D904,546 | S | 12/2020 | Cheng et al. |
| D906,562 | S | 12/2020 | Hawk et al. |
| 11,274,901 | B2 | 3/2022 | Burgess |
| D963,780 | S | 9/2022 | McKelvain et al. |
| D969,953 | S | 11/2022 | Fogg et al. |
| D969,954 | S | 11/2022 | Fogg et al. |
| D995,700 | S | 8/2023 | Liu |
| 11,906,267 | B2 * | 2/2024 | Meissen ..... F41G 1/35 |
| 2009/0122527 | A1 | 5/2009 | Galli |
| 2011/0107643 | A1 | 5/2011 | Fitzpatrick et al. |
| 2013/0228532 | A1 | 9/2013 | Carr |
| 2015/0041538 | A1 | 2/2015 | Teetzel |
| 2015/0233668 | A1 | 8/2015 | Moore |
| 2015/0276347 | A1 | 10/2015 | Sharrah et al. |
| 2016/0018071 | A1 | 1/2016 | Sharrah et al. |
| 2017/0082399 | A1 | 3/2017 | Moore et al. |
| 2019/0145730 | A1 | 5/2019 | Chavez |
| 2019/0242674 | A1 | 8/2019 | Berean |
| 2022/0341703 | A1 | 10/2022 | Ball et al. |
| 2023/0175814 | A1 | 6/2023 | Meissen et al. |

OTHER PUBLICATIONS

Instagram post "Rapid Illumination Grip". 1 pages, posted Feb. 10, 2022 by user "crimsontrace." Date Accessed: Jan. 4, 2024. Retrieved from Internet URL: https://www.instagram.com/p/CZzdowSoRca/ (Year: 2022).

Istagram post "The RIG". 1 pages, posted Feb. 10, 2022 by user "crimsontrace." Date Accessed: Jan. 4, 2024. Retrieved from Internet URL: https://www.instagram.com/p/CY9a_b1Ogzh/?img_index=1 (Year: 2022).

Vism Vert Grip with Flashlight—You Tube, Date Accessed May 23, 2024. Retrieved from Internet UL:https://www.youtube.com/watch?v=iQfWVIMAIE.

NPL Search Innovation Q=Year: 2023, 5 pages.

NPL Search Innovation Q+Year: 2024.

* cited by examiner

FIREARM FOREGRIP WITH ILLUMINATOR

CROSS-REFERENCE TO RELATED APPLICATION

The present application is a continuation of and claims priority to U.S. application Ser. No. 18/411,536, filed Jan. 12, 2024, which is a continuation of and claims priority to U.S. application Ser. No. 17/983,391, filed Nov. 8, 2022, now issued U.S. Pat. No. 11,906,267, which claims priority to U.S. Provisional Patent Application No. 63/263,705, filed Nov. 8, 2021, the entireties of which are hereby incorporated by reference.

FIELD

The present disclosure generally relates to firearm accessories, and more particularly to firearm grips and/or illuminators.

BACKGROUND

Various types of grips and illuminators are used on firearms. Improvements are needed.

SUMMARY

In one aspect, a firearm illuminator system comprises a firearm mount configured to be connected to a firearm. The firearm illuminator system includes an illuminator supported by the firearm mount. The illuminator includes a light source. A support body receiver is supported by the firearm mount. A support body is selectively connectable to the support body receiver. The support body includes at least one of an actuator configured to change an operational state of the light source or a port configured to connect a remote to the support body.

Other objects and features of the present disclosure will be in part apparent and in part pointed out herein.

BRIEF DESCRIPTION OF THE DRAWINGS

Corresponding reference numbers indicate corresponding parts throughout the drawings.

DETAILED DESCRIPTION

Figure 1:
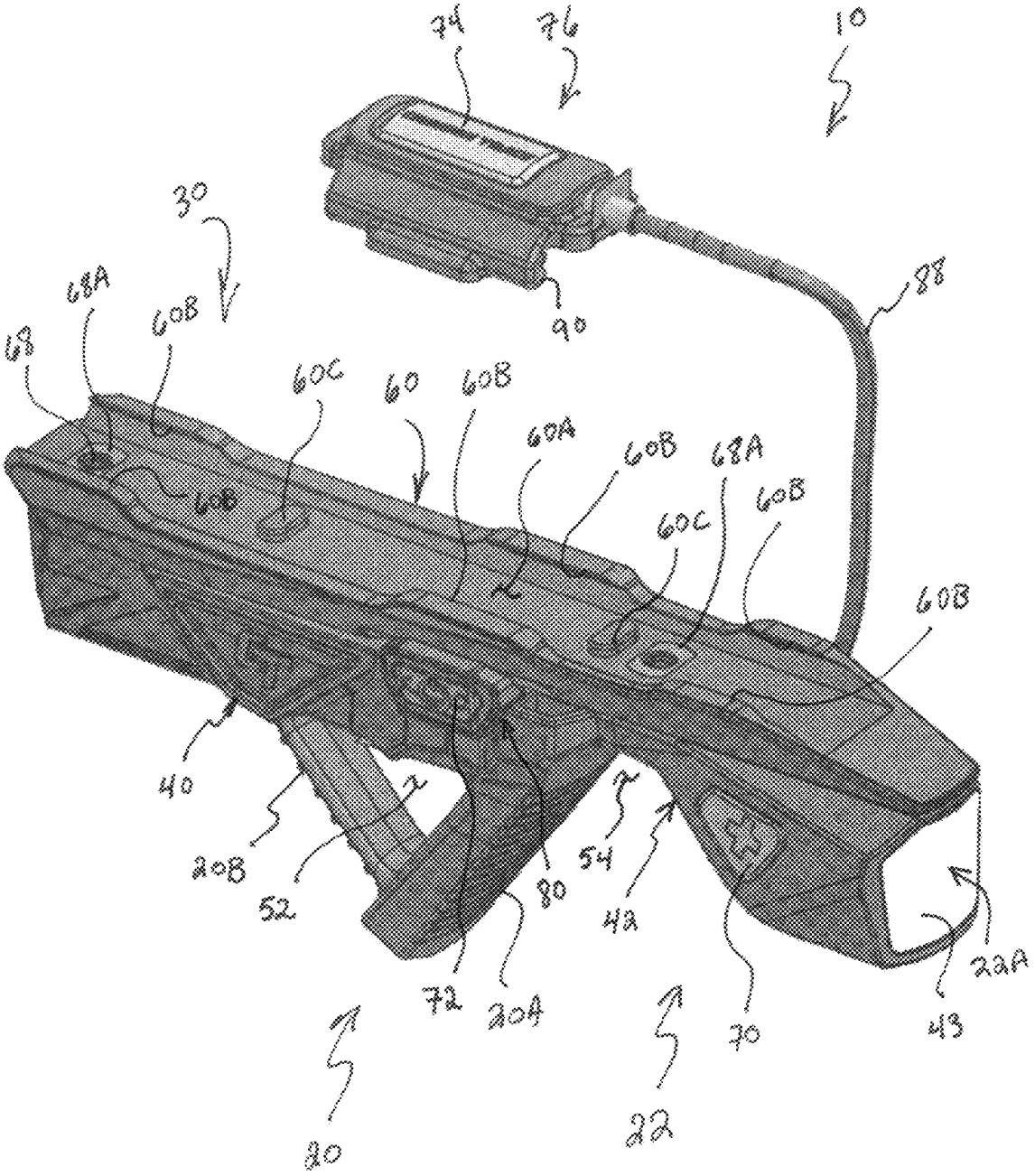
FIG. 1 a front perspective of a firearm accessory of the present disclosure.
Figure 2:
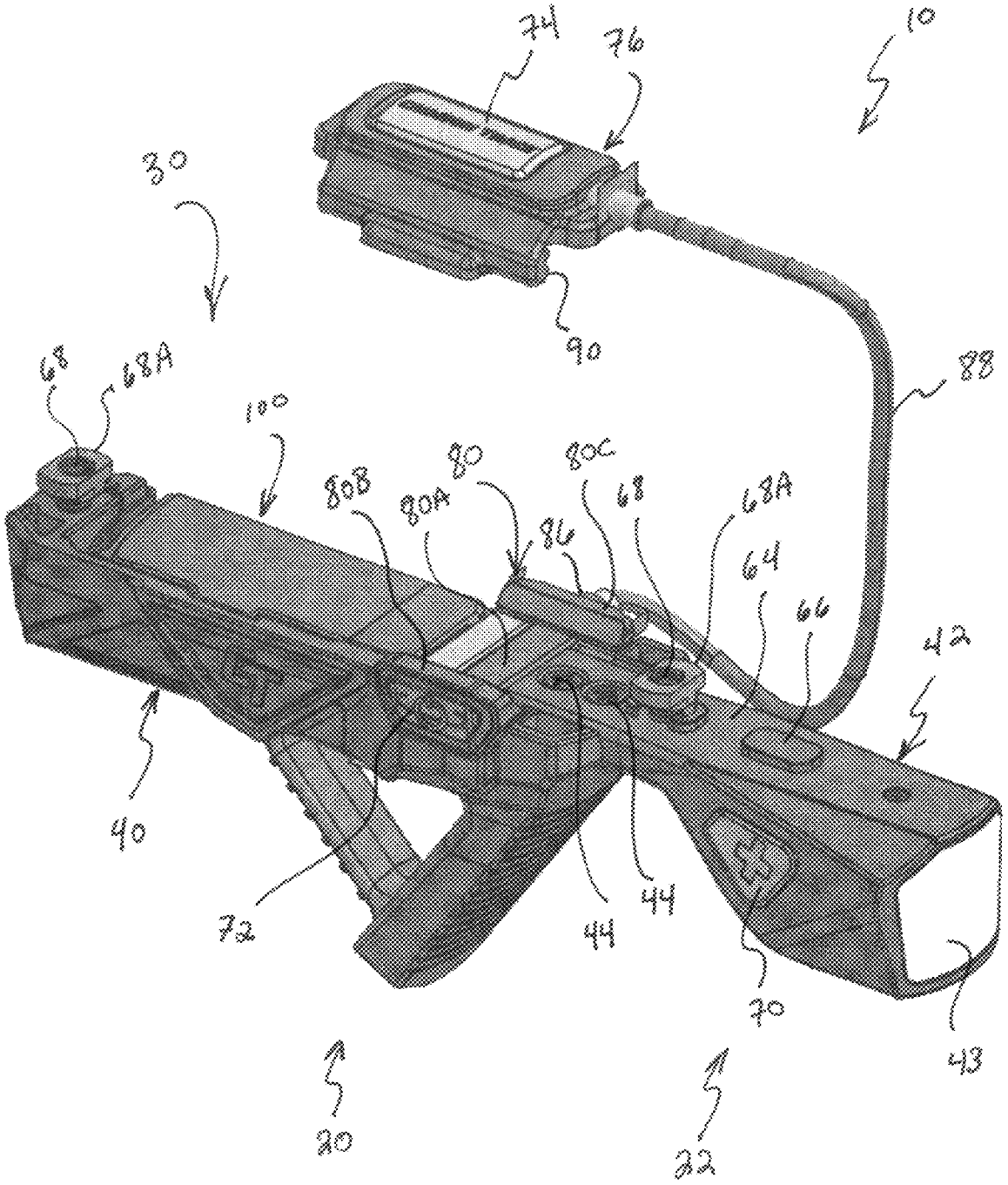
FIG. 2 is a front perspective similar to FIG. 1 but omitting a firearm mount adaptor.
Figure 3:
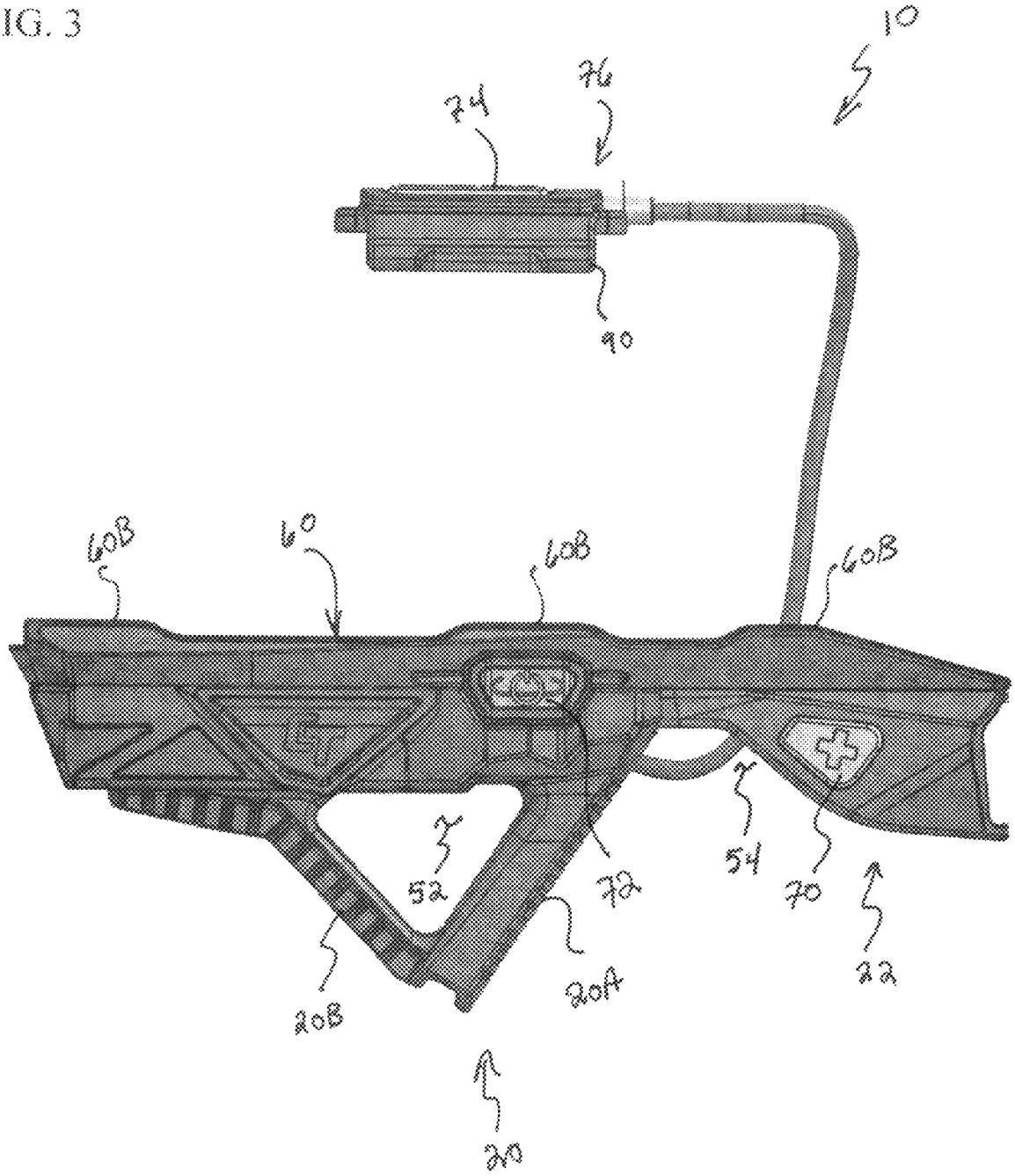
FIG. 3 is a right side elevation of the firearm accessory.

Referring to FIGS. 1-3, a firearm accessory of the present disclosure is generally indicated by 10. In the illustrated embodiment, the firearm accessory comprises an angled foregrip 20 (broadly, "grip" or "firearm grip") and an illuminator 22 and is configured for use with an AR style rifle. It will be appreciated that features disclosed herein can be used on other types of firearm accessories (e.g., firearm illuminators such as lights and/or lasers, other types of grips, other types of firearms, etc.) without departing from the scope of the present disclosure. Moreover, it will be appreciated that the illuminator may be omitted, or the foregrip may be omitted, without departing from the scope of the present disclosure.

In general, the accessory 10 includes a firearm mount 30, the angled foregrip 20, the illuminator 22, and a user interface (e.g., one or more actuators) configured to facilitate user interaction with the illuminator. The accessory includes a main body comprising a first body component 40 and a second body component 42. The first body component 40 can be formed of polymer material (e.g., injection molded plastic), and the second body component 42 can be formed of metal (e.g., aluminum). The aluminum helps dissipate heat from the light source. Other materials can be used. The first body component 40 forms part of the firearm mount and forms the angled foregrip 20. The second body component 42 forms a housing of the illuminator 22. The first and second body components are secured to each other in a suitable manner (e.g., via screws 44 or other fasteners).

The illuminator 22 includes a light source 22A, which in the illustrated embodiment comprises an LED (behind a front lens 43). The light source is configured to emit light forward from a front end of the accessory 10 (e.g., for illuminating an environment or target in front of the firearm). It will be appreciated the light source could alternatively or in addition include a laser.

The angled foregrip 20 is located behind the illuminator 22 and provides a forward grip 20A and a rear grip 20B which the user can grip to help steady or aim the firearm. An opening 52 is provided in the body behind the angled foregrip 20. A recess 54 is also provided in front of the grip 20A and behind the illuminator 22 to permit the user to position part of their hand between the grip and the illuminator. The illuminator housing 42 is relatively narrow above this recess.

The firearm mount 30 (e.g., a first firearm mount) is configured to connect to different types of firearm mounting structure. In particular, the firearm mount can be used to connect the accessory to M-LOK type mounting structure and to Picatinny type mounting structure. To connect to the Picatinny type mounting structure, the firearm mount includes an adaptor 60. The adaptor is not used for mounting to the M-LOK type mounting structure. Other configurations can be used without departing from the scope of the present disclosure. For example, the mount 30 can be configured to connect to other firearm mounting structure.

Figure 4:
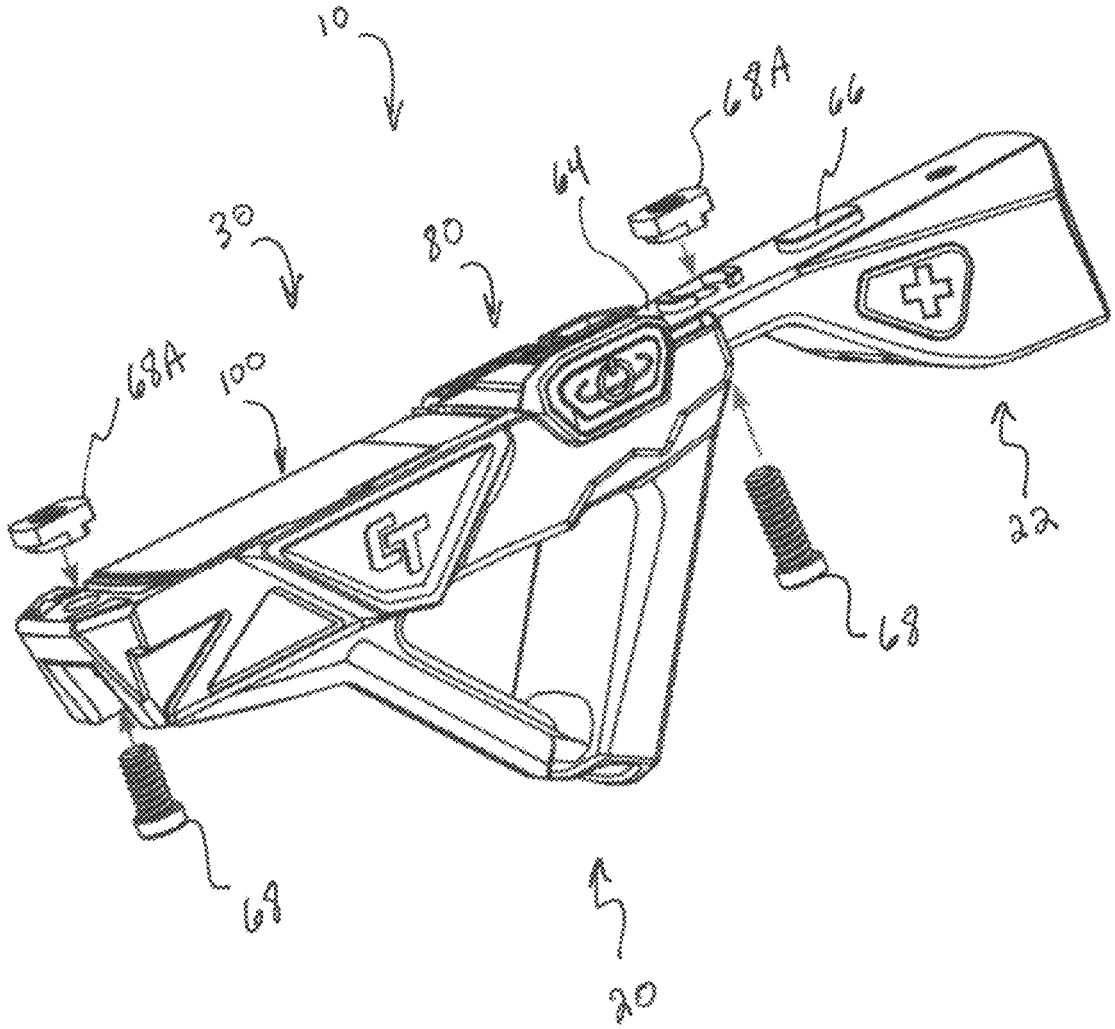
FIG. 4 is a perspective of the firearm accessory omitting the firearm mount adaptor and with fasteners and nuts shown removed.

Referring to FIGS. 2 and 4, to connect to the M-LOK type connection structure, the firearm mount 30 includes a base 64 formed by the body of the accessory, and includes a protrusion 66 and first and second fasteners 68. The fasteners include T-shaped nuts 68A for reception in openings in the M-LOK type connection structure. The mount 30 is connected to the M-LOK connection structure by inserting the T-shaped nuts 68A into the openings of the mounting structure, and rotating the fasteners 68 to turn the T-shaped nuts into retaining relationship with respect to the openings, and to draw the T-shaped nuts toward the accessory body. Heads of the fasteners 68 are accessible from the bottom for engaging the heads with a tool (e.g., hex wrench or screw driver). The protrusion 66 may be received in another opening of the connection structure. When the fasteners 68 are tightened, the nuts 68A remain in retaining relationship with respect to the M-LOK connection structure, and the body of the accessory is held against the M-LOK connection structure. To remove the accessory 10, the fasteners 68 are turned to be loosened, which turns the T-shaped nuts 68A out of retaining relationship. Other configurations can be used without departing from the scope of the present disclosure.

Figure 5:
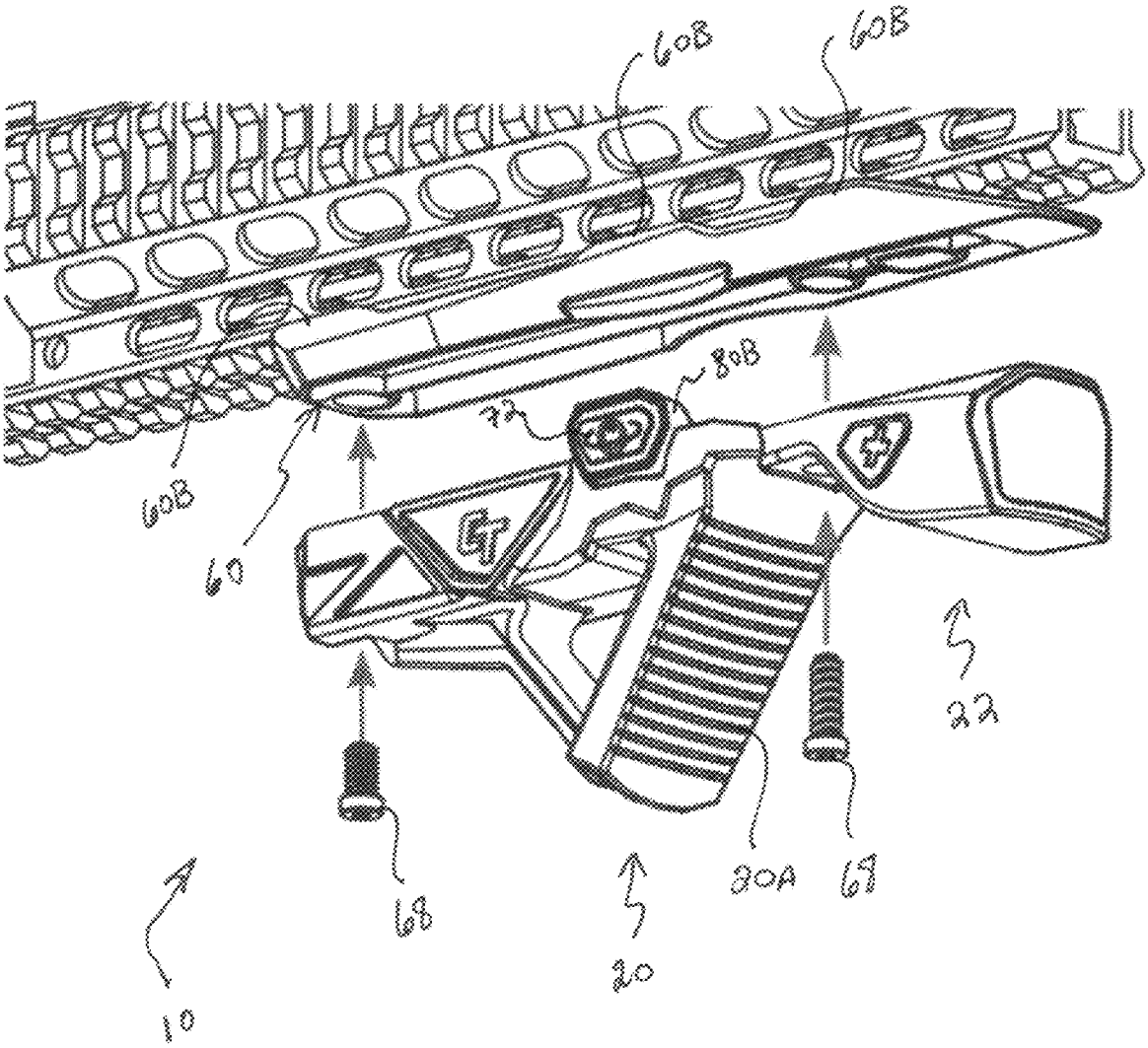
FIG. 5 is a fragmentary perspective of a firearm having the firearm mount adaptor connected thereto and the accessory body shown separated from the adaptor.
Figure 6:
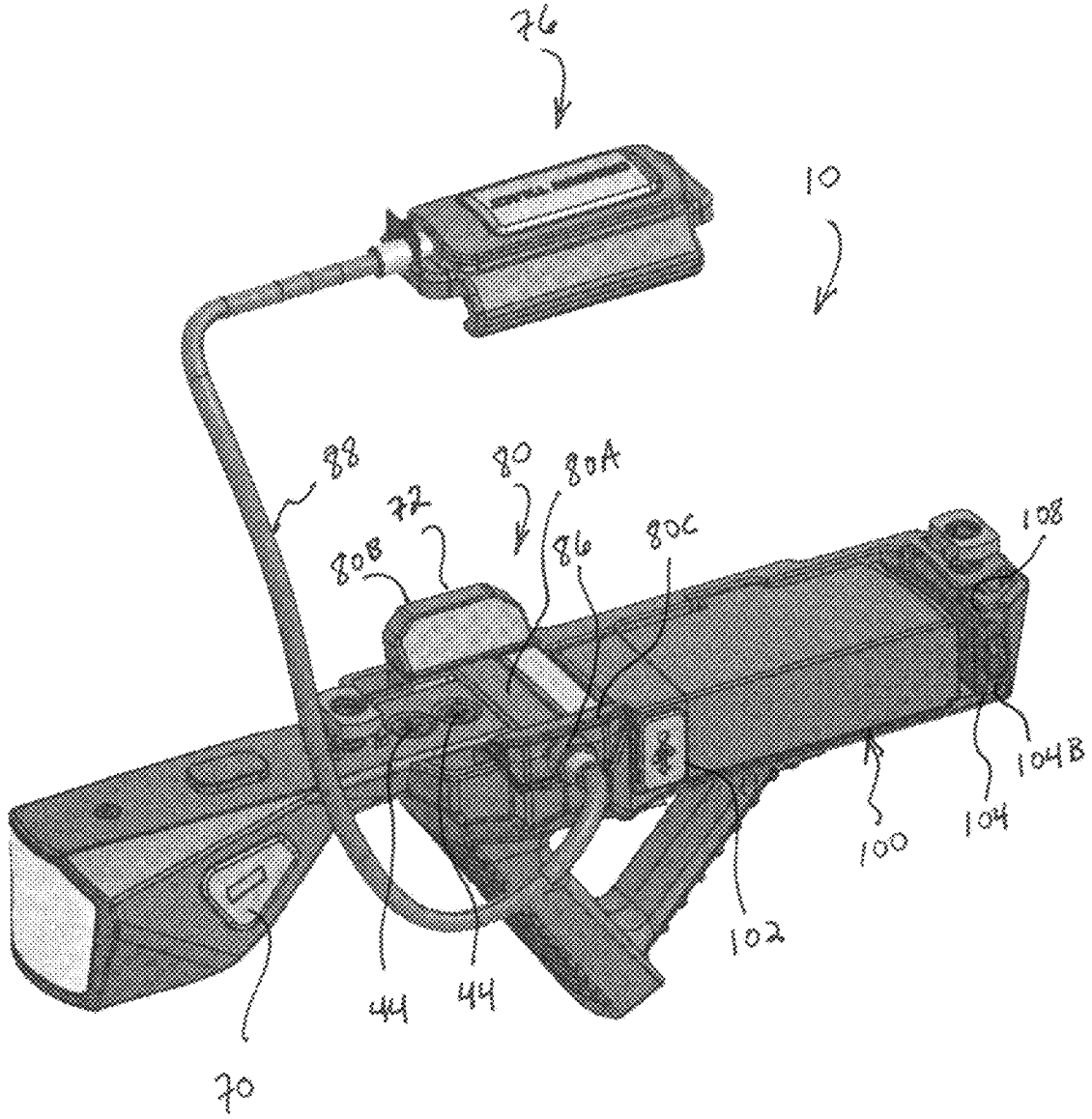
FIG. 6 is another perspective of the firearm accessory omitting the firearm mount adaptor.

Referring to FIGS. 1, 3, and 5, to connect to the Picatinny type connection structure, the adaptor 60 is used. The adapter can be formed of a polymeric material (e.g., injection molded plastic) or other suitable material. The adaptor 60 includes an adaptor body defining a channel 60A in which the Picatinny rail is receivable. The adaptor is installed on the Picatinny rail to capture the rail. The adaptor 60 includes arms 60B that capture the rail therebetween to hold the adaptor on the rail. For example, the arms 60B can be resiliently deformable to permit the adaptor to be "snapped" onto the rail to form a friction-fit, dovetail type connection with the rail. The adaptor 60 also includes protrusions 60C configured to fit in recesses in the rail to limit longitudinal movement of the adaptor on the rail. The body of the accessory 10 is connected to the adaptor using two fasteners 68. The T-shaped nuts 68A are installed in corresponding recesses in the adaptor 60 and threadably receive the fasteners 68 to secure the body to the adaptor. Other configurations can be used without departing from the scope of the present disclosure.

The user interface for manipulating the light source will now be discussed in more detail. In the illustrated embodiment, the user interface includes mode actuators 70 (e.g., plus and minus buttons, such as dome switches under associated flexible coverings) on opposite sides of the illuminator housing to permit the user to selectively increase or decrease the light emitted by the light source. Other types of modes (e.g., strobe, light/laser, etc.) and mode actuators can be used without departing from the scope of the present disclosure.

The user interface also includes at least one on/off actuator. In the embodiment shown in FIG. 2, a first on/off actuator is provided as a button 72 on the side of the accessory 10 and a second is provided as switch 74 of a remote 76 tethered to the accessory body.

Figure 7:
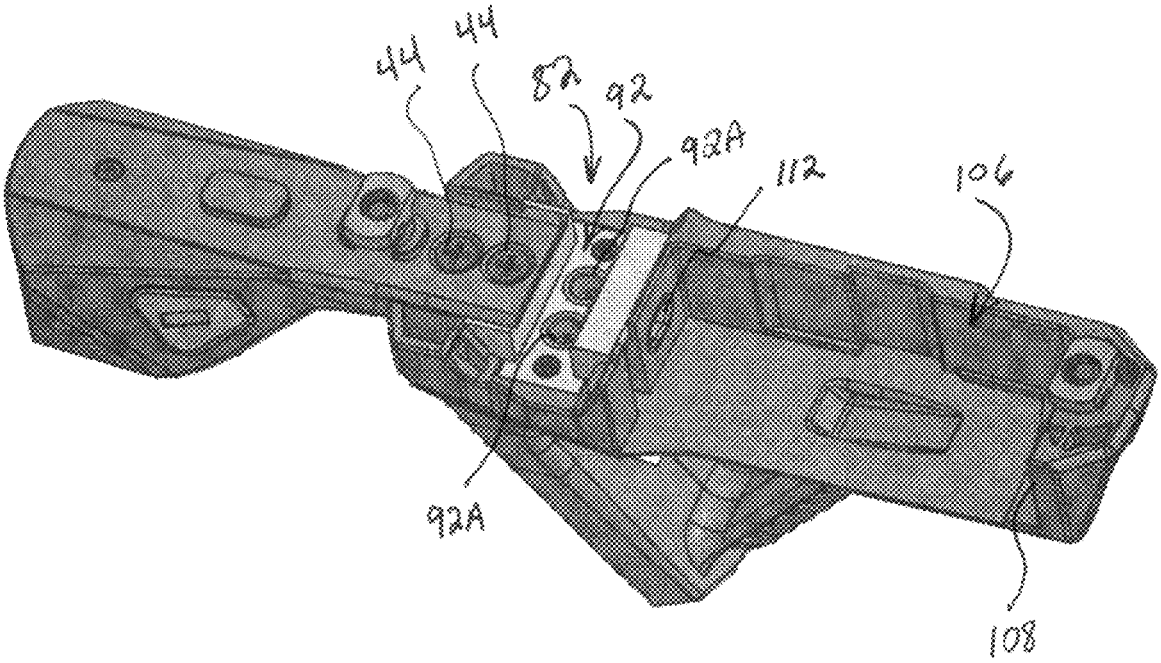
FIG. 7 is a perspective of the firearm accessory with components removed to show a support body receiver and a battery pack receiver.
Figure 8:
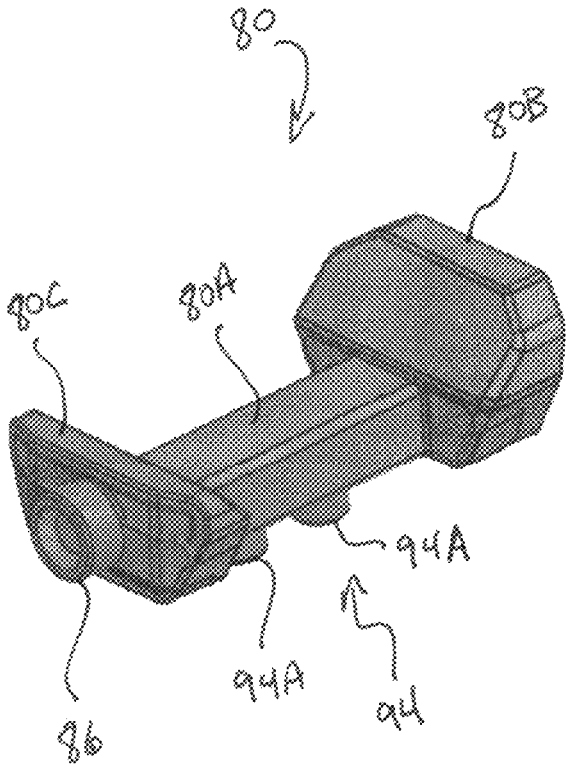
FIG. 8 is perspective of the support body.
Figure 9:
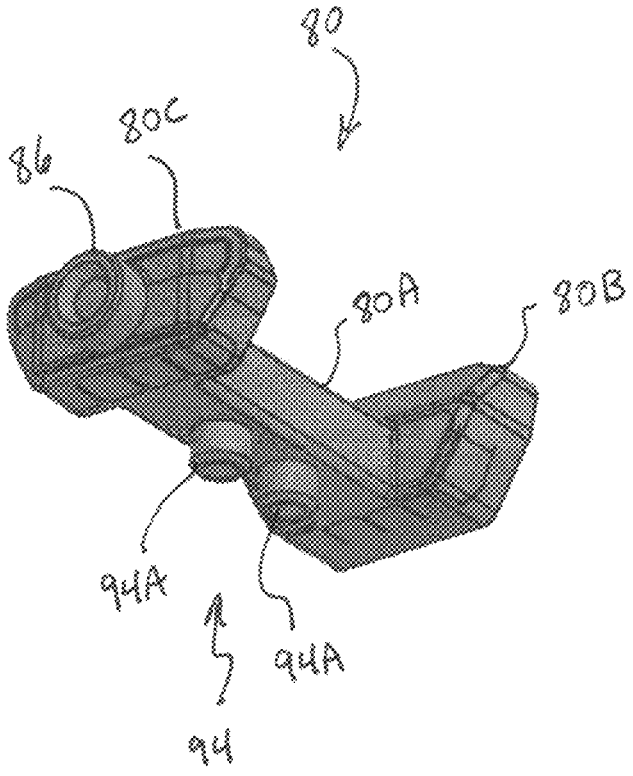
FIG. 9 is another perspective of the support body.
Figure 10:
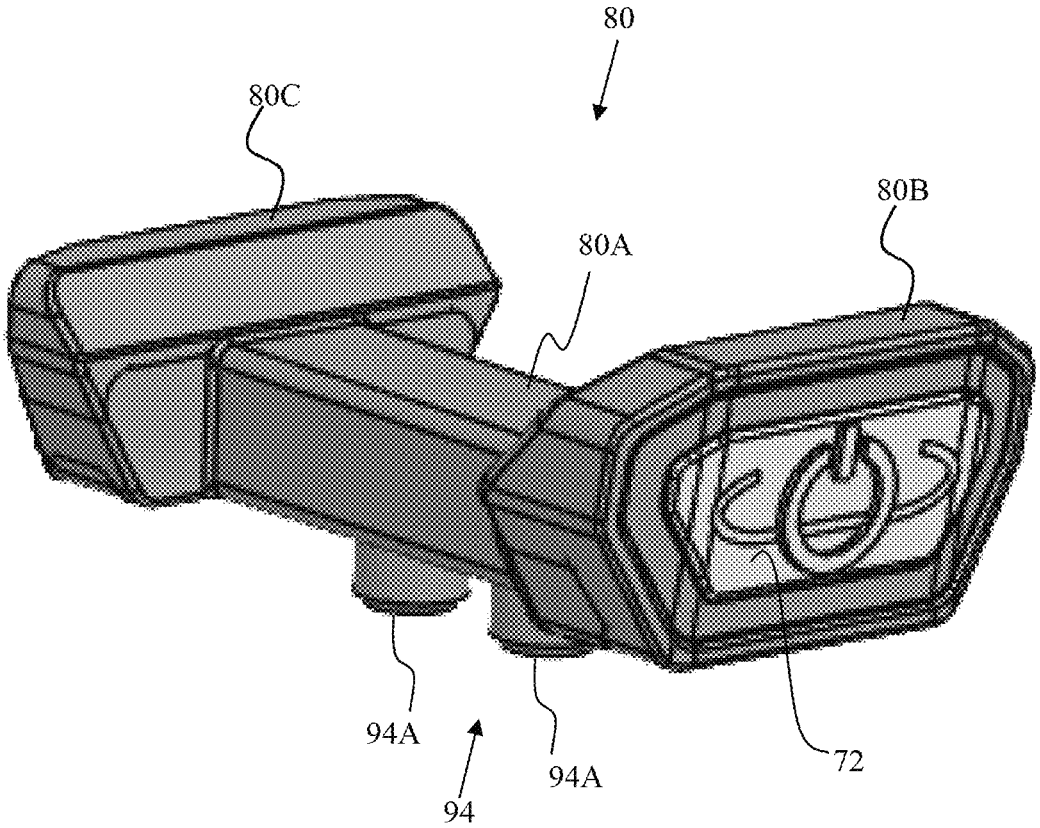
FIG. 10 is another perspective of the support body.
Figure 11:
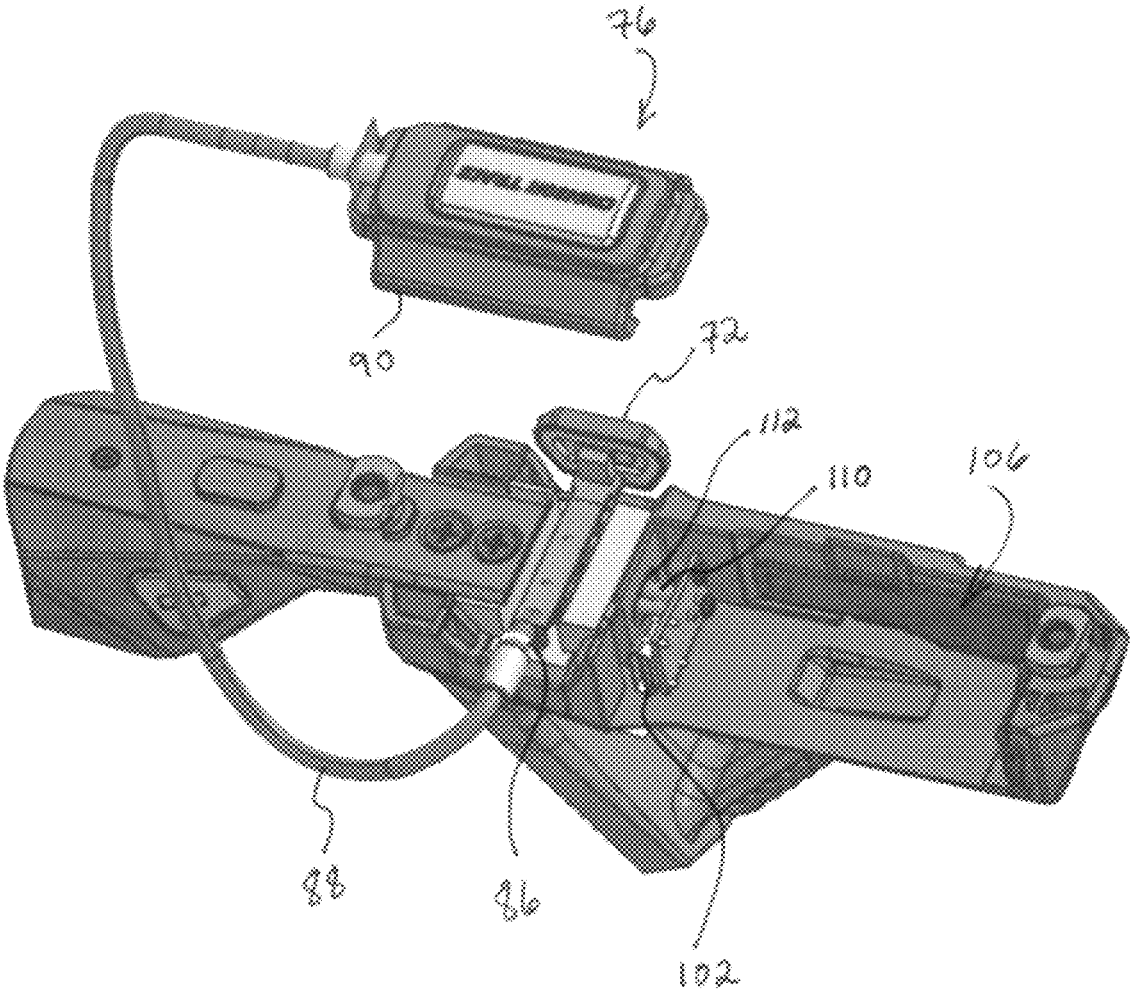
FIG. 11 is a perspective of the firearm accessory having components removed to show circuitry of the support body and a connector of the battery pack operatively connected to each other via connection structure of the accessory body.

Still referring to FIGS. 2 and 8-10, the user interface includes a support body 80 receivable in a receiver 82 (FIG. 7) (e.g., a support body receiver) of the accessory body. The illustrated support body on one end includes the on/off actuator 72, and on the other end includes a port 86 for connecting a tether or cord 88 of the remote 76. Thus, on one side of the accessory 10, the user can have an on/off switch 72 (onboard on/off actuator), and on the other side, the user can connect the tether 88 from the remote 76 (offboard on/off actuator).

The remote 76 can connect to mounting structure provided on the firearm, such as a rail of the firearm. The remote 76 can includes a firearm mount 90 (e.g., a second firearm mount) configured to be connected to the firearm separately from the firearm mount 30 (e.g., the first firearm mount) of the accessory 10. For example, the firearm mount 90 of the remote 76 can include a pair of resiliently deflectable jaws or arms configured to "snap" onto and grip opposite sides of the rail. The onboard actuator 72 and offboard actuator 74 can each include a dome switch or other suitable type of switch for controlling the light source. Besides an on/off function based on pressing and releasing the switch, the switches 72, 74 can function as momentary switches by which the light source is on only for the time the user holds the switch. Other configurations can be used without departing from the scope of the present disclosure.

The support body 80 is reversible such that the orientation of the support body can be switched to swap the positions of the onboard actuator 72 and the port 86 for the remote 76. Thus, the onboard actuator 72 can be provided on the left side or the right side of the accessory 10. Likewise, the port 86 for the remote 76 can be provided on the left side or the right side. To change the orientation, the support body 80 is removed, rotated 180 degrees, then reinstalled. This provides for customization according to the desires of the user.

The support body 80 includes an intermediate portion 80A that extends widthwise across the accessory body, and includes two wider end portions 80B, 80C that extend transversely with respect to the intermediate portion 80A and extend along sides of the accessory body and are received in side cavities of the accessory body.

The receiver 82 includes a port 92 for electrically connecting the support body with the receiver. The port includes two female connectors 92A. The support body 80 includes a port 94 comprising two male connectors 94A configured for reception in the female connectors 92A of the receiver 82. The support body port 94 is connectable to the receiver port 92 in the alternative mounting configurations of the support body on the receiver. In one aspect, the ports can be symmetrical to facilitate such orientation changes. It will be appreciated that other configurations can be used without departing from the scope of the present disclosure. For example, the male and female connectors may be swapped, and/or the ports may comprise one connector instead of two.

The support body 80 includes circuitry (e.g., suitable wiring, circuit structure, etc.) electrically connecting the onboard actuator 72 to the receiver connection port 94 and electrically connecting the remote actuator port 86 to the receiver connection port 94.

Figure 12:
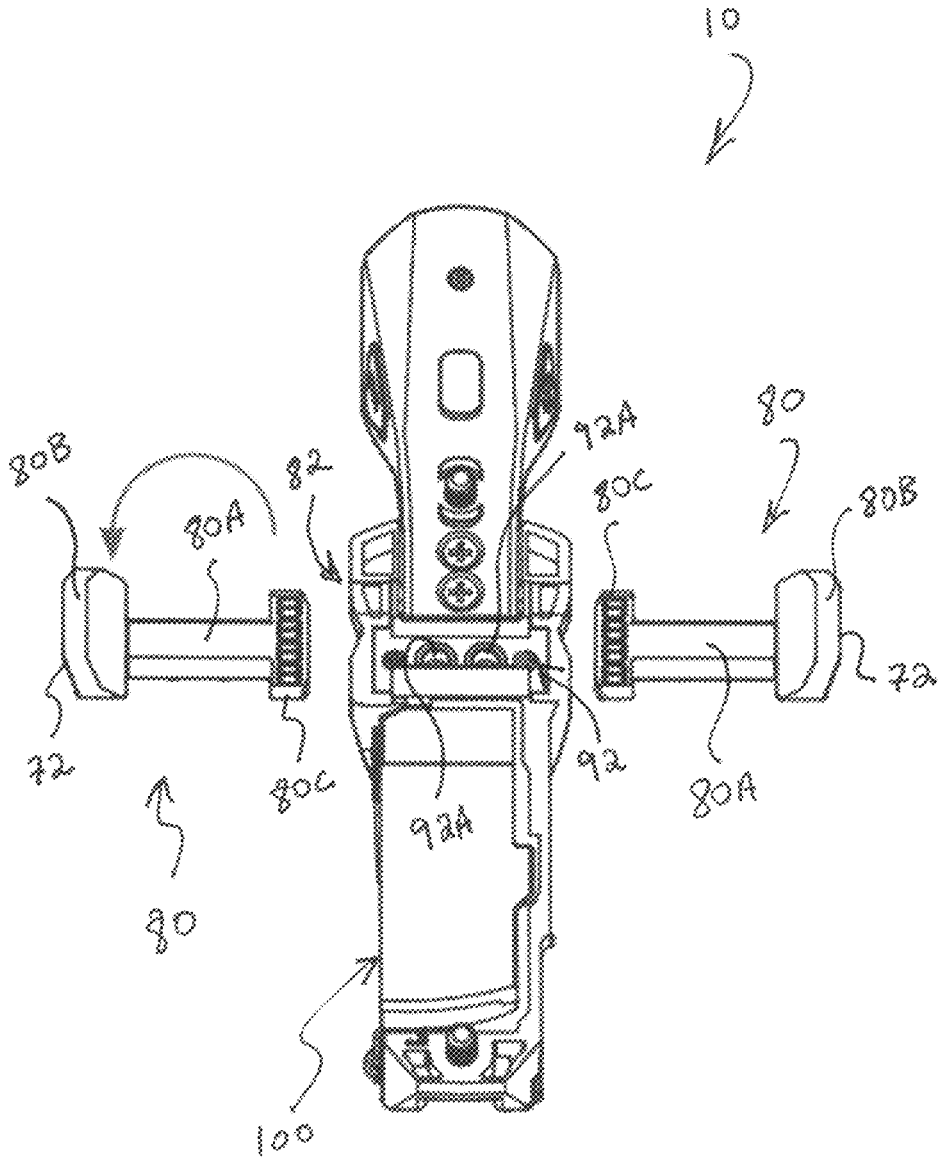
FIG. 12 is a top perspective of the accessory body with a first alternate embodiment of the support body shown in duplicate to represent two orientations for connecting to the support body receiver.
Figure 13:
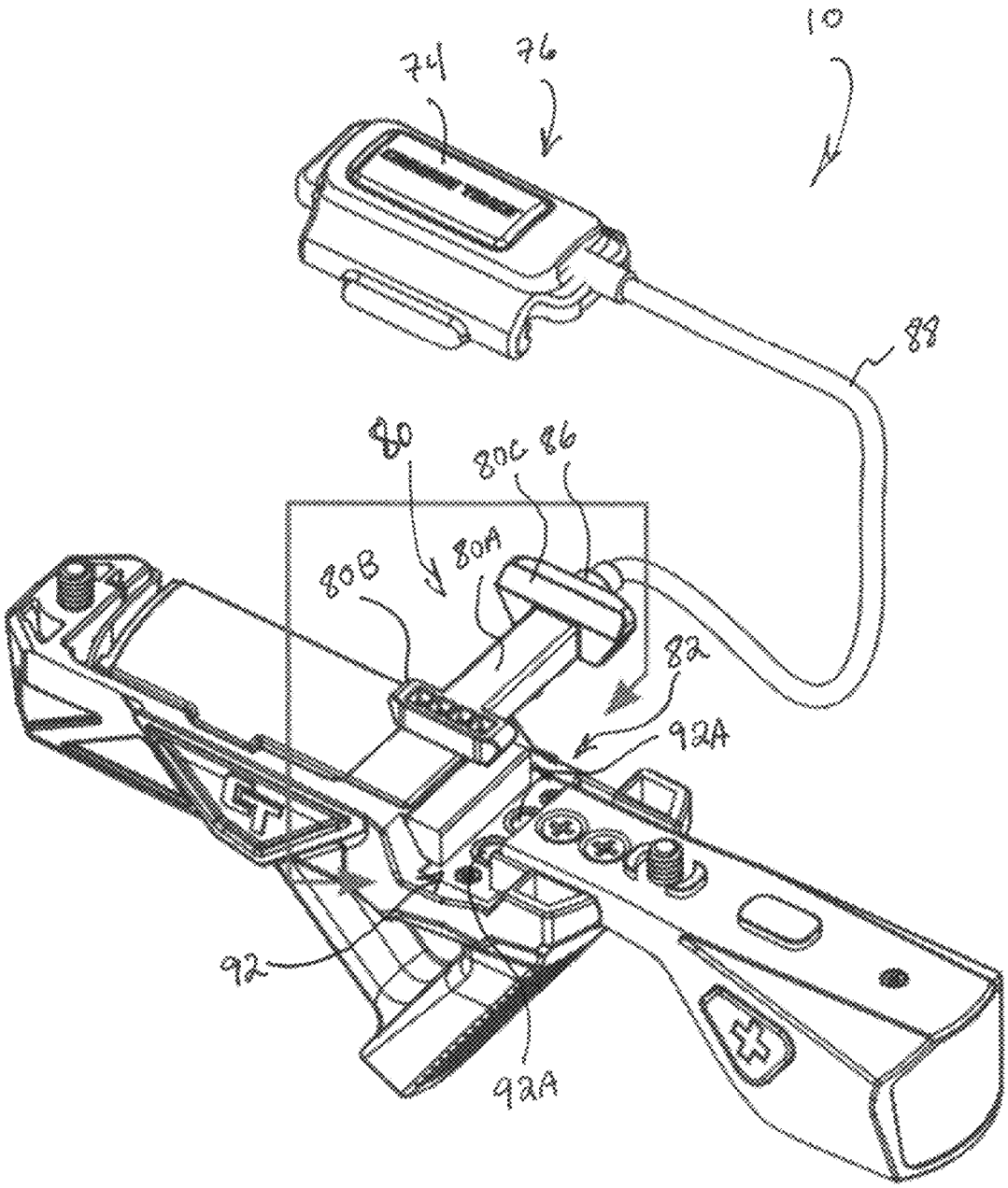
FIG. 13 is a perspective of the accessory body with a second alternate embodiment of the support body for connecting a tethered remote to the support body, arrows shown to indicate two orientations for connecting the support body to the support body receiver.
Figure 14:
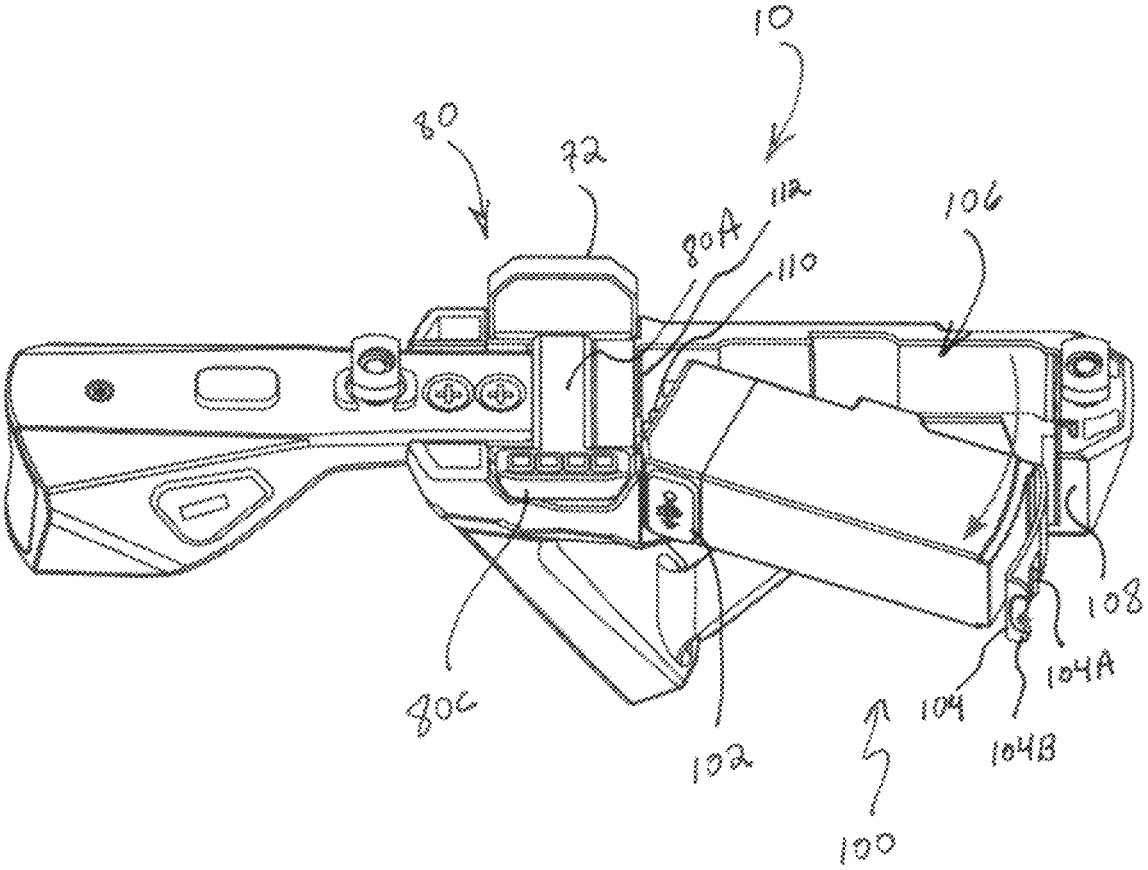
FIG. 14 is top perspective of the firearm accessory showing the battery pack partially removed.

In alternative embodiments of the support body, the support body is configured to include the onboard actuator 72 or the remote actuator port 86, not both. For example, a kit of support bodies 80 may be provided, so the user can choose whether to use the onboard actuator 72 or the remote actuator 74. If the onboard actuator 72 is chosen, as shown in FIGS. 12 and 14, the support body 80 having the onboard actuator 72 is installed. On the other hand, if the remote actuator 74 is chosen, as shown in FIG. 13, the support body 80 having the port 86 for the remote actuator 74 is installed. It will be appreciated that these support bodies 80 can be mounted to provide the onboard actuator 72 or the remote actuator port 86 on the left side or right side of the accessory. This provides for customization according to the desires of the user.

Referring to FIG. 14, in the illustrated embodiment, the power source is provided in the form of a removable battery pack 100. For example, the battery pack 100 can include one or more lithium battery cells. The battery pack 100 includes a charging port 102 (e.g., USB port with cover) permitting the battery to be recharged. The port 102 is arranged to be accessible for charging while the battery is on the accessory body, but the battery can be removed from the accessory body for charging.

The battery pack 100 includes a retainer 104 for releasably retaining the battery pack on the accessory body. The accessory body includes a battery receiver 106 configured to receive the battery pack. The battery receiver 106 includes a keeper 108 configured to engage the retainer 104 (e.g., a latch 104A of the retainer) to releasably secure the battery to the receiver. The battery pack 100 includes a battery port 110 configured to connect to a power port 112 of the accessory body. In the illustrated embodiment, the battery port 110 comprises two male connectors, and the power port 112 comprises two female connectors. To install the battery pack 100, the ports 110, 112 are located in registration with each other, and then the battery pack is pivoted to cause the ports to engage and cause the retainer 104 to resiliently deflect. When the battery pack is fully pivoted into the receiver 106, the retainer 104 "snaps" into retaining engagement with the keeper 108 and releasably retains the battery in the receiver and the ports in engagement with each other. To remove the battery pack 100, the user engages an arm 104B of the releasable retainer 104 to deflect the latch 104A out of the retainer, and then pivots the battery out of the receiver, as shown below. It will be appreciated that other configurations can be used without departing from the scope of the present disclosure.

Figure 15:
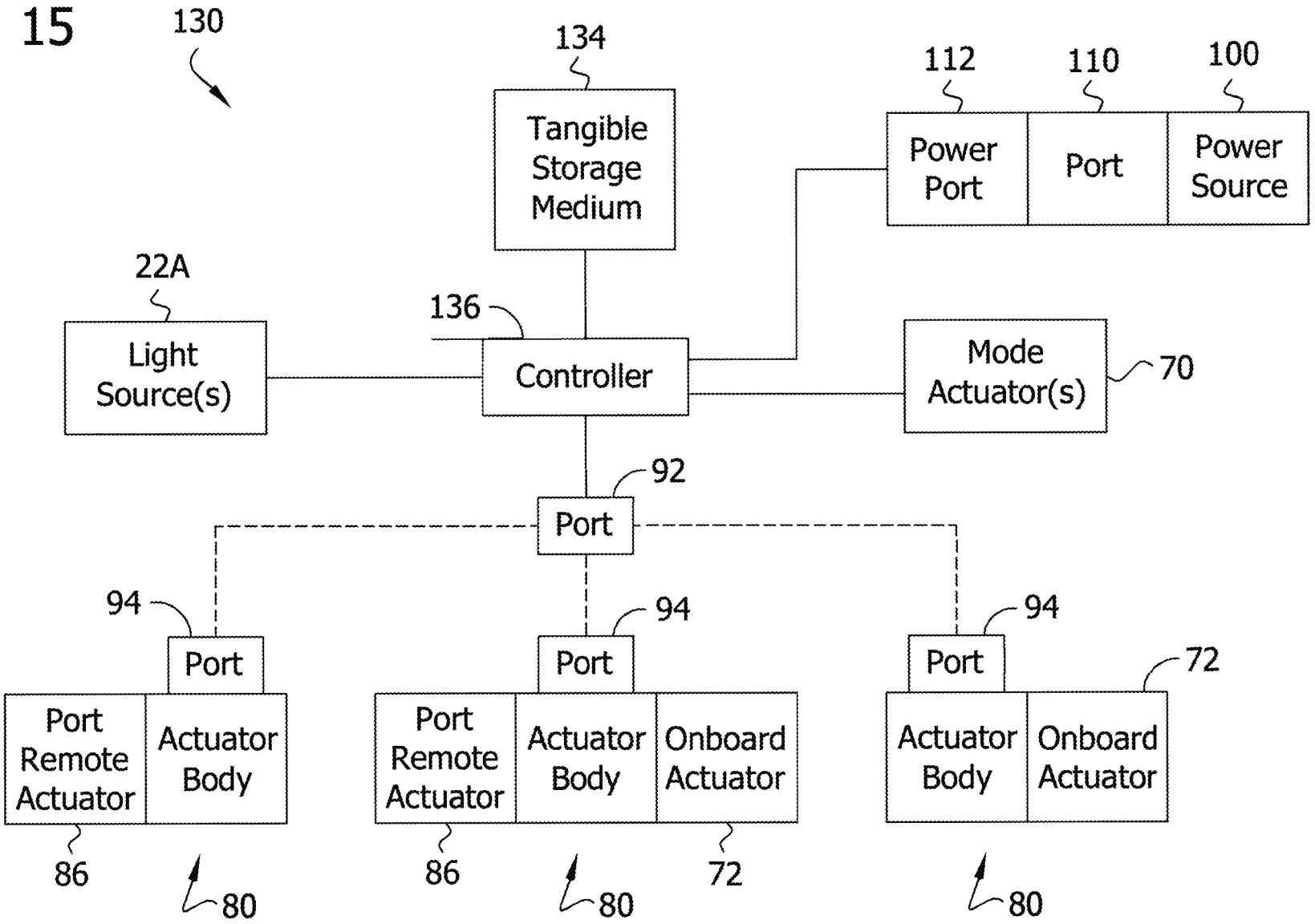
FIG. 15 is a schematic of a control system of the firearm accessory.

An example schematic of a control system 130 of the accessory 10 is shown in FIG. 15, with alternative structures for the various support bodies 80 disclosed above (onboard actuator 72 and remote actuator port 86, onboard actuator 72 only, and remote actuator port 86 only). The control system 100 includes tangible storage medium 134 includes instructions executable by an accessory controller 136 to perform functions described herein. The accessory controller 136 is responsive to the actuators of the accessory to, for example, turn on/off the illuminator and/or change modes, etc.

It will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A firearm illuminator system for a firearm, the firearm illuminator system comprising:

a battery pack having one or more battery cells;

an accessory body having a firearm mount configured to be connected to the firearm to connect the firearm illuminator system to the firearm, the accessory body including a battery receiver configured to removably receive the battery pack to removably connect the battery pack to the accessory body; and a light source supported by the accessory body, the battery pack configured to power the light source when the battery pack is received in the battery receiver; and a support body selectively connectable to the accessory body, the support body including at least one of an actuator configured to change an operational state of the light source or a port configured to connect a remote to the support body.

2. The firearm illuminator system of claim 1, wherein the support body includes the actuator configured to change the operational state of the light source.

3. The firearm illuminator system of claim 2, wherein the actuator is configured to turn the light source on and off.

4. The firearm illuminator system of claim 1, in combination with the remote and a tether connected to the remote, and wherein the support body includes the port, the tether being operatively connectable to the port to connect the remote to the port.

5. The firearm illuminator system of claim 4, wherein the firearm mount is a first firearm mount, and wherein the remote includes a second firearm mount configured to be connected to the firearm separately from the first firearm mount.

6. The firearm illuminator system of claim 5, wherein the remote comprises an actuator configured to change an operational state of the light source.

7. The firearm illuminator system of claim 4, wherein the support body includes the actuator and the port.

8. The firearm illuminator system of claim 1, wherein the battery receiver comprises a battery pack space sized and shaped to receive the battery pack.

9. The firearm illuminator system of claim 8, wherein the battery pack space has an open side sized and shaped to permit the battery pack to be inserted into and removed from the battery pack space through the open side.

10. The firearm illuminator system of claim 9, wherein the open side is arranged to permit the battery pack to be visible when the battery pack is received in the battery receiver.

11. The firearm illuminator system of claim 9, wherein the battery pack space has a closed bottom.

12. The firearm illuminator system of claim 1, further comprising a retainer configured to secure the battery pack to the battery receiver.

13. The firearm illuminator system of claim 12, wherein the battery pack includes the retainer.

14. The firearm illuminator system of claim 12, further comprising a keeper configured to be engaged by the retainer to secure the battery pack to the battery receiver.

15. The firearm illuminator system of claim 14, wherein the battery receiver includes the keeper.

16. The firearm illuminator system of claim 12, wherein the retainer comprises a resiliently deflectable latch.

17. The firearm illuminator system of claim 1, wherein the battery pack includes a charging port for charging the one or more battery cells.

18. The firearm illuminator system of claim 1, wherein the light source is arranged to emit light in a forward direction along a longitudinal axis of the firearm illuminator system, the battery pack and the battery receiver are configured so that the battery pack is moveable sideways relative to the longitudinal axis into and out of the battery receiver.

19. The firearm illuminator system of claim 1, wherein the battery pack and the battery receiver are configured so that the battery pack is pivotable into the battery receiver to connect the battery pack to the accessory body and out of the battery receiver to disconnect the battery pack from the accessory body.

20. The firearm illuminator system of claim 1, wherein the accessory body includes a foregrip configured to be gripped by a hand of the user, the foregrip disposed below the battery receiver.

* * * * *